US010012035B2

(12) United States Patent
Andrigo

(10) Patent No.: US 10,012,035 B2
(45) Date of Patent: Jul. 3, 2018

(54) EASY-START CENTRALIZER WITH ASYMETRICAL BOW SPRINGS

(71) Applicant: TOP-CO INC., Weatherford, TX (US)

(72) Inventor: Gregory James Alexander Andrigo, Almonte (CA)

(73) Assignee: TOP-CO INC., Houston, TX (US)

( * ) Notice: Subject to any disclaimer, the term of this patent is extended or adjusted under 35 U.S.C. 154(b) by 392 days.

(21) Appl. No.: 14/733,066

(22) Filed: Jun. 8, 2015

(65) Prior Publication Data

US 2015/0354291 A1 Dec. 10, 2015

Related U.S. Application Data

(60) Provisional application No. 62/010,017, filed on Jun. 10, 2014.

(51) Int. Cl.
*E21B 17/10* (2006.01)

(52) U.S. Cl.
CPC ..... *E21B 17/1078* (2013.01); *E21B 17/1028* (2013.01); *Y10T 29/49828* (2015.01)

(58) Field of Classification Search
CPC ... Y10T 29/49828; E21B 17/00; E21B 17/10; E21B 17/101; E21B 17/1021; E21B 17/1028; E21B 17/1078; E21B 17/1085; E21B 19/24; E21B 23/00; E21B 23/02
USPC ..... 166/241.6, 172, 213, 241, 1, 381, 382; 175/325.5
See application file for complete search history.

(56) References Cited

U.S. PATENT DOCUMENTS

| | | | | |
|---|---|---|---|---|
| 2,642,141 A | | 6/1953 | Kolb | |
| 3,055,432 A | * | 9/1962 | Park | E21B 17/1028 15/104.19 |
| 3,556,042 A | * | 1/1971 | Laughlin | E21B 17/1028 166/241.7 |
| 3,575,239 A | * | 4/1971 | Solum | E21B 17/1028 166/241.7 |
| 4,520,869 A | * | 6/1985 | Svenson | E21B 17/1028 166/172 |
| 6,102,118 A | | 8/2000 | Moore | |
| 8,196,670 B2 | | 6/2012 | Jenner | |
| 2012/0186828 A1 | | 7/2012 | Lively et al. | |

FOREIGN PATENT DOCUMENTS

| | | | | |
|---|---|---|---|---|
| DE | 3508086 C1 | | 8/1986 | |
| EP | 0196339 A1 | * | 10/1986 | E21B 17/1028 |
| GB | 2201176 A | | 8/1988 | |

OTHER PUBLICATIONS

EP0196339 Google Translation.*

(Continued)

*Primary Examiner* — George S Gray
(74) *Attorney, Agent, or Firm* — Pillsbury Winthrop Shaw Pittman LLP

(57) ABSTRACT

A centralizer having asymmetrical bow springs defining a more gradual lead-in angle and a steeper retreat angle to reduce the required insertion and running forces. The centralizer comprises two end bands and a plurality of bow springs connecting the two shaped to gradually contact the surrounding hole or well casing. The bow springs are arranged such that a least two of them are asymmetric and positioned such that the apex of each is the same distance from an end band.

17 Claims, 5 Drawing Sheets

(56) References Cited

OTHER PUBLICATIONS

United States International Searching Authority; International Search Report & Written Opinion for PCT/US2015/034864; dated Aug. 25, 2015; 9 pages; Alexandria, VA; US.
European Patent Office; Extended European Search Report; dated May 29, 2017; 7 pages; The Hague.

* cited by examiner

DETAIL D

DETAIL E

EASY-START CENTRALIZER WITH ASYMETRICAL BOW SPRINGS

FIELD OF INVENTION

This invention generally relates to centralizers, and in particular to centralizers having compressible bow springs.

BACKGROUND OF THE INVENTION

Centralizers are commonly used in oil and gas wellbore installations and generally serve to center a pipe or casing within the wellbore during run-in, installation and cementing procedures. Conventional centralizers are typically characterized by a pair of opposed stop collars or stop rings with a number of outwardly-bowed springs extending therebetween to contact the wellbore sidewalls and exert a centering force on the pipe or casing segment.

As drilling projects are pushed to greater well depths, increased drilling angles, and through a greater variety of formations, more challenging demands are placed on centralizers and other down-bore equipment. For example, deeper wells are requiring more stages and passage of centralizers through a greater range and number of corresponding restrictions.

Conventional bow springs can suffer from a number of disadvantages in such installations. For example, conventional centralizer bow spring profiles often present steep lead-in angles which can make them difficult to compress. As the bore restrictions become increasingly tighter, the starting or insertion force and running forces required to pass restrictions increase significantly. Additionally, compression of the bow springs through particularly tight restrictions can exceed the elastic range of the material, leading to deformation of bow springs, compromising the restoring and centering ability thereafter.

U.S. Pat. No. 3,575,239 and U.S. Pat. No. 8,196,670 propose to reduce centralizer starting or running forces via alternating longitudinal offsetting of the bow springs. For example, the '239 patent proposes offsetting bow springs that are "symmetrical from end to end" by varying the bow spring attachment points, e.g., welds, on the stop collar. Similarly, the '670 patent proposes shifting symmetrical bow arch profiles towards one or the other of the stop collars via provision of a flat extension or "substantially axis parallel portion" at alternating ends of the bow spring profiles. Thus, both of these earlier proposed centralizers rely solely on longitudinal offsetting of otherwise symmetrical bow springs to reduce the required starting force, i.e., by reducing the number of bows simultaneously starting through a restriction. Such centralizers can still require abrupt starting forces, although incrementally divided somewhat by the longitudinal offsets.

Accordingly, improvements are sought in reducing and controlling starting or insertion forces and running forces and preserving centralizer integrity against the increasing demands of deep-well drilling.

SUMMARY OF THE INVENTION

While the way that the present invention addresses the disadvantages of the prior art will be discussed in greater detail below, in general, the present invention provides a centralizer with easy-start bow springs having a profile defined by a more gradual approach slope or angle and a steeper trailing slope or angle. Stated otherwise the easy-start bow springs have a substantially longer incline or approach profile relative to the decline or trailing profile. A longer approach profile provides a more gradual, less abrupt increase in resistance as the centralizer bow springs engage, are compressed by, and ultimately clear a restriction.

For example, the starting and running forces required typically depend on the number and material composition of the bow springs as well as the ratio of the outer diameter of the centralizer to the inner diameter of a restriction. The forces required can be very high since the bow springs are often compressed from between 60% to 90% of their original height. In contrast to the steep lead-in angles presented by many conventional centralizers, the novel asymmetrical profile presents a more gradual approach slope or shallow lead-in requiring lower forces to compress the bow springs as they engage and clear small restrictions.

One aspect of the invention features, in some embodiments, an asymmetric bow spring profile, i.e., in which the slope of the bow is asymmetrical about the centerline of the bow arch.

In some embodiments, the average slope of the bow approach is substantially less than about 45 degrees and the average slope of the bow retreat is substantially greater than about 45 degrees.

In some embodiments, the average slope of the lead-in approach is between about 5-30 degrees.

In some embodiments, the average slope of the bow approach is about three-fourths of the average slope of the bow retreat.

In some embodiments, the average slope of the bow approach is about two-thirds of the average slope of the bow retreat.

In some embodiments, the average slope of the bow approach is about one-half of the average slope of the bow retreat.

Another aspect of the invention features in some embodiments, a shallow lead-in angle on one side of the bow spring.

In some embodiments, the bow springs of the centralizer are uniformly asymmetrical.

In some embodiments, fewer than all of the bow springs are asymmetrical.

In some embodiments, the apexes of some of the bow springs are longitudinally offset from the apexes of others of the bow springs.

In some embodiments, the more-gradual lead-in angle is characterized by a substantially linear bow-spring profile between one of the stop collars and an apex of the respective bow spring arch.

In some embodiments, a trailing end of at least one of the bow springs is free to translate relative to a trailing one of the stop collars.

Another aspect of the invention features, in some applications, a method of making a centralizer including providing a pair of opposed stop collars and connecting the stop collars with a plurality of bow springs extending therebetween. At least two of the plurality of bow springs define an asymmetrical profile characterized by a more-gradual lead-in profile and a steeper retreat profile.

In some applications, the method includes positioning an apex of the at least two of the plurality of bow springs offset by between 20-30 percent from a midpoint of the distance between the stop collars.

In some applications, the steeper retreat profile is characterized by a transition from a convex profile to a concave profile.

In some applications, the more-gradual lead-in profile is characterized by a substantially linear angled profile between one of the stop collars and an apex of the respective bow spring.

In some applications, a trailing end of at least one of the bow springs is free to translate relative to a trailing one of the stop collars.

In some applications, an opposed pair of bow springs has a different degree of apex offset from an adjacent pair of opposed bow springs.

In some applications, the method includes fixing at least one end of each bow spring within a recess defined in the stop collar.

Another aspect of the invention features, in some applications, a method of positioning casing within a wellbore using a centralizer having asymmetrical bow springs defining a shallow or gradual lead-in to reduce starting and running forces required for the centralizer and casing to clear a restriction.

In some applications, the bow springs of the centralizer are uniformly asymmetrical.

In some applications, fewer than all of the bow springs are asymmetrical.

In some applications, the apexes of some of the bow springs are longitudinally offset from the apexes of others of the bow springs.

BRIEF DESCRIPTION OF THE DRAWINGS

A more complete understanding of the present invention may be derived by referring to the detailed description and claims when considered in connection with the Figures, wherein like reference numerals refer to similar elements throughout the Figures.

DETAILED DESCRIPTION

The following description is of exemplary embodiments of the invention only, and is not intended to limit the scope, applicability or configuration of the invention. Rather, the following description is intended to provide a convenient illustration for implementing various embodiments of the invention. As will become apparent, various changes may be made in the function and arrangement of the elements described in these embodiments without departing from the scope of the invention as set forth herein. It should be appreciated that the description herein may be adapted to be employed with alternatively configured devices having different shapes, components, mechanisms and the like and still fall within the scope of the present invention. Thus, the detailed description herein is presented for purposes of illustration only and not of limitation.

Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

In the following description, certain terminology is used to describe certain features of one or more embodiments of the invention. For example, a "bow spring" as described herein may include, but is not necessarily limited to, a distinct formed component assembled with a pair of stop collars or an integral component formed from the same material stock as the stop collars. The stop collars and bow springs may be constructed from a wide variety of materials including, but not necessarily limited to, spring steel, metal, composite materials, plastics, or any combination thereof. Any number bow springs or combination of bow spring profiles or bow spring positions may be used in accordance with various embodiments. It is understood that any process now known or later developed for forming bow springs may be used in accordance with the present invention.

Figure 1A:
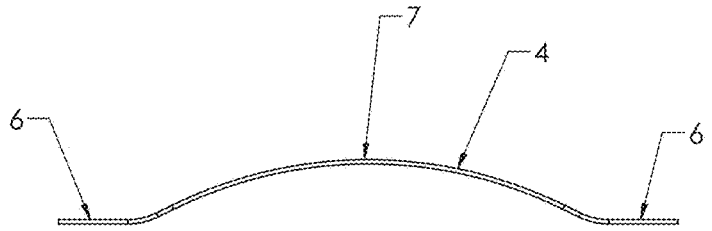
FIG. 1A (PRIOR ART)
FIG. 1*a* illustrates a side view of a prior art symmetrical bow spring profile.
Figure 1B:
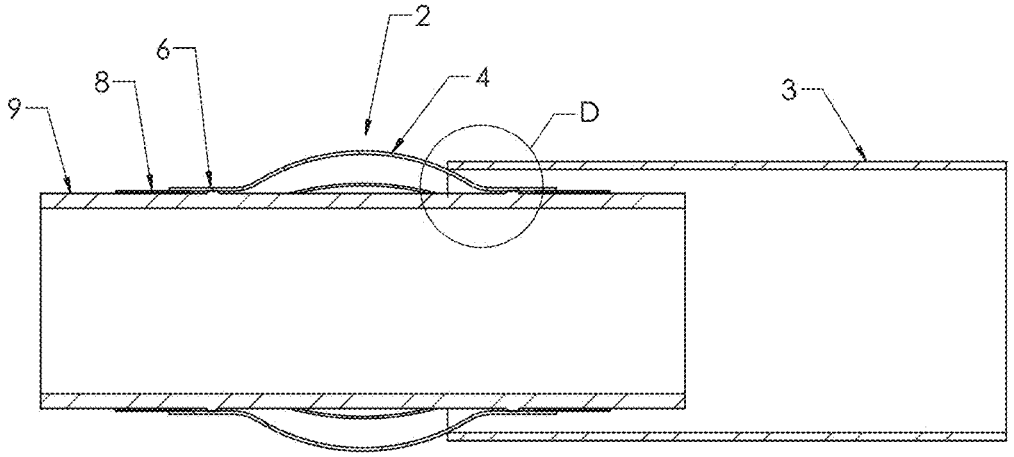
FIG. 1B (PRIOR ART)
FIG. 1*b* illustrates a cross-sectional view of a prior art symmetrical centralizer during insertion into a casing.
Figure 1C:
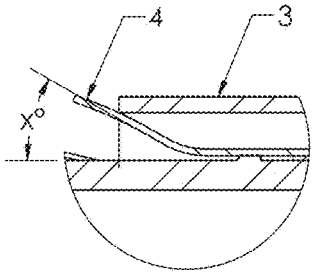
FIG. 1C (PRIOR ART)
FIG. 1*c* illustrates enlarged Detail D from FIG. 1*b* of the prior art symmetrical centralizer.

With reference now to FIGS. 1*a*-1*c*, a prior art centralizer 2 with bow springs 4 is characterized by symmetrical profiles. With reference to FIG. 1*a*, a prior art bow spring 4 is substantially symmetrical about the bow arch apex 7 or centerline. Attachment landings 6 at either end of the bow spring are used to attach bow springs 4 to stop collars 8. With reference to FIG. 1*b*, insertion of the prior art centralizer 2 leads to abrupt compression upon engagement of the bow spring arch with the opening of casing 3. With reference to FIG. 1*c*, Detail D shows more abrupt angle X formed between bow springs 4 and the supporting centralizer sub 9 during insertion into casing 3.

Figure 2A:
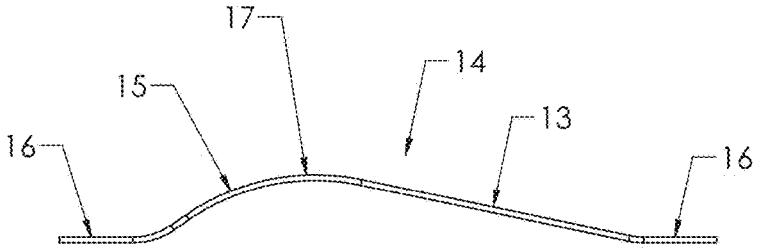
FIG. 2*a* illustrates a side view of one embodiment of an asymmetrical bow spring profile.
Figure 2B:
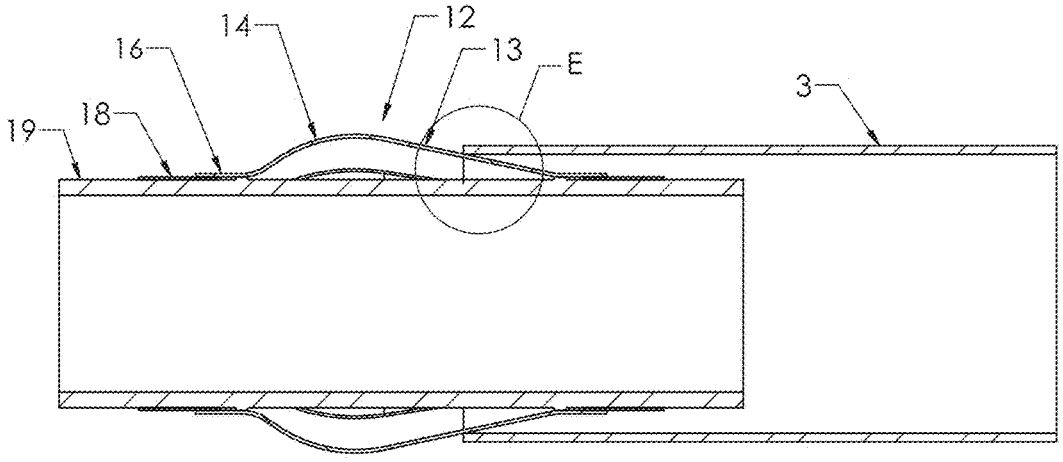
FIG. 2*b* illustrates a cross-sectional view of one embodiment of an asymmetrical centralizer during insertion into a casing.
Figure 2C:
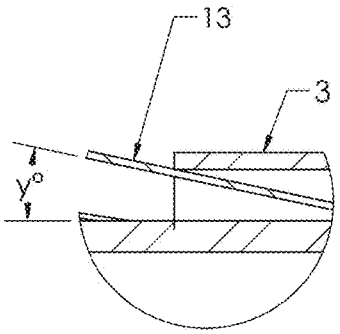
FIG. 2*c* illustrates enlarged Detail E from FIG. 2*b* of one embodiment of an asymmetrical centralizer.

In contrast, with reference now to FIGS. 2*a*-2*c*, one embodiment of a centralizer 12 having asymmetrical bow springs 14 is shown. With reference to FIG. 2*a*, bow spring 14 is characterized by a shallow lead-in angle or leading profile 13, a steeper angle of retreat or trailing profile 15 and an offset apex 17 relative to the midpoint of the bow length. With reference to FIG. 2*b*, the shallow lead-in angle Y of the leading profile 13 of asymmetrical bow spring 14, according to one embodiment of the present invention, provides a more gradual compression and engagement of the bow spring arch with the opening of casing 3. This more gradual engagement of bow springs 14 reduces insertion forces and running forces as centralizer sub 19 and centralizer 12 move through casing 3.

In contrast to earlier proposed designs, aspects of the present invention allow for shorter overall centralizer lengths, e.g., by eliminating the need to offset the bows. This is particularly significant in subsea applications that include centralizer subs, i.e., short casing joints with integral centralizers. Shorter subs are less expensive and easier to handle because of reduced weight and size.

Figure 3A:
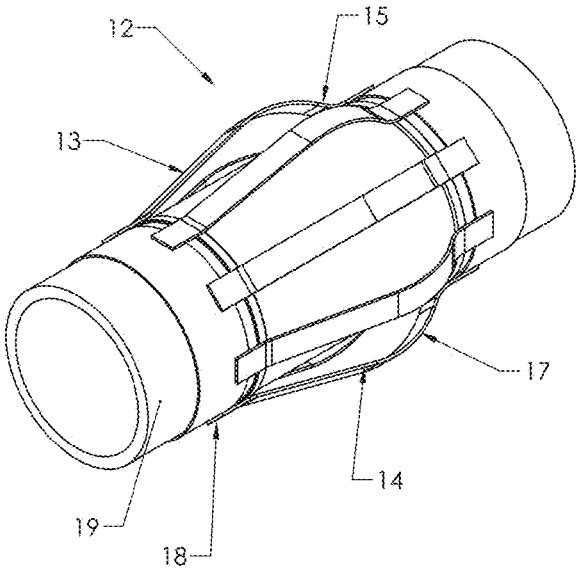
FIG. 3*a* illustrates a perspective view of one embodiment of a centralizer having asymmetrical bow springs.
Figure 3B:
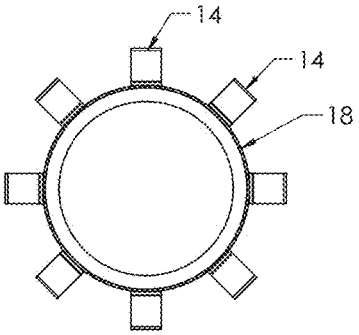
FIG. 3*b* illustrates an end view of one embodiment of a centralizer having asymmetrical bow springs.
Figure 3C:
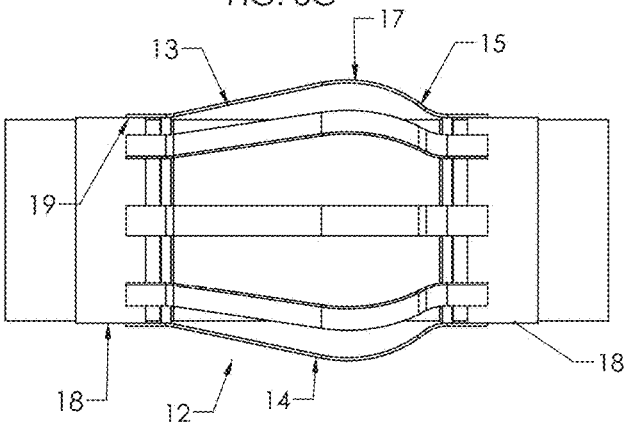
FIG. 3*c* illustrates a side view of one embodiment of a centralizer having asymmetrical bow springs.

With reference to FIGS. 3*a*-3*c*, different views of a centralizer device 12 having bow springs 14 with asymmetrical profiles are illustrated. Bow springs 14 define a shallow or gradual lead-in slope profile 13 and a steeper retreat slope profile 15. The gradual lead-in slope profile 13 serves to reduce and smooth the degree of insertion forces required in starting the centralizer through a casing opening or other restriction.

Figure 4A:
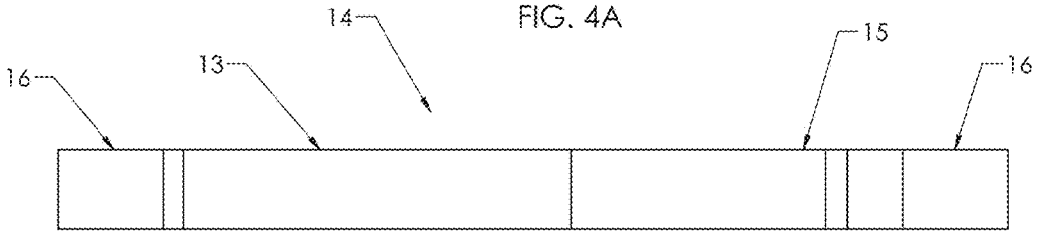
FIG. 4*a* illustrates a top view of an asymmetrical bow spring defining a shallow lead-in angle.
Figure 4B:
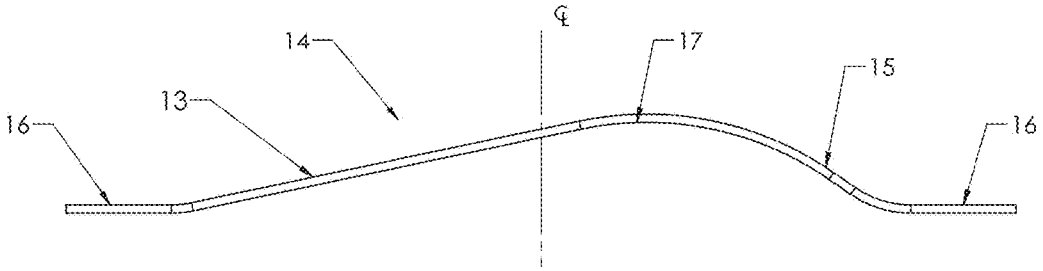
FIG. 4*b* illustrates a side view of an asymmetrical bow spring defining a shallow lead-in angle.
Figure 4C:
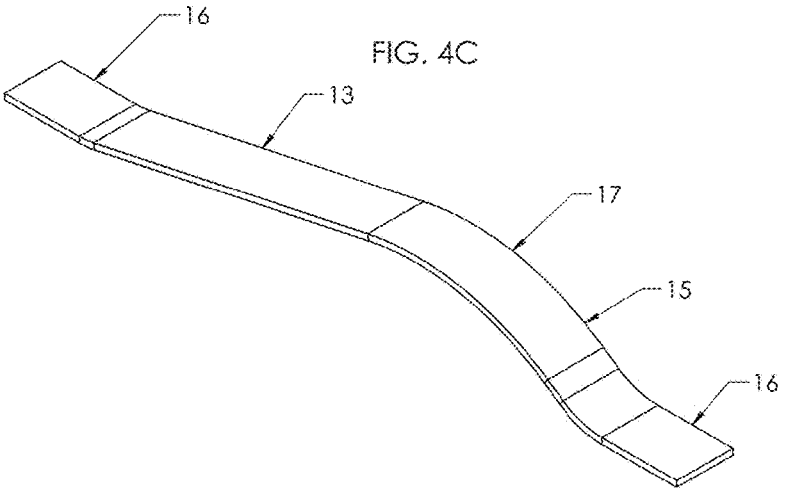
FIG. 4*c* illustrates a perspective view of an asymmetrical bow spring defining a shallow lead-in angle.

With reference now to FIGS. 4*a*-4*c*, a bow spring 14 according to one embodiment of the present invention is characterized by an asymmetric profile. The apex 17 of the bow spring profile is not collocated with the centerline of the bow spring arch, producing a lesser incline slope profile 13 and a greater decline slope profile 15 than a conventional symmetrical bow spring profile (see FIGS. 1*a*-1*c*). This lesser or more shallow slope provides advantages of reduced insertion forces and more gradual engagement with the casing through more gradual compression of bow springs 14.

In some embodiments, centralizer 12 is formed by securing landings 16 of bow springs 14 to stop collars 18. In some embodiments, stop collars 18 define recesses to receive landings 16. In some embodiments, the trailing landing can be slidably coupled to the trailing stop collar to allow for movement of the trailing landing independent of the stop collar during compression. In some embodiments, opposing pairs of bow springs have different longitudinal offsets of the profile apex relative to adjacent pairs of bow springs. In some embodiments, the bow springs are formed by bending steel straps to the desired profile. In some embodiments, the stop collars are formed by joining two semi-circular halves. In some embodiments the collar 18 and bow spring 14 are formed as one piece from the same material. In some embodiments the bow springs 14 are secured to the stop collar 18 using mechanical joining methods. In some embodiments the bow springs 14 are welded to the stop collars 18.

Figure 5B:
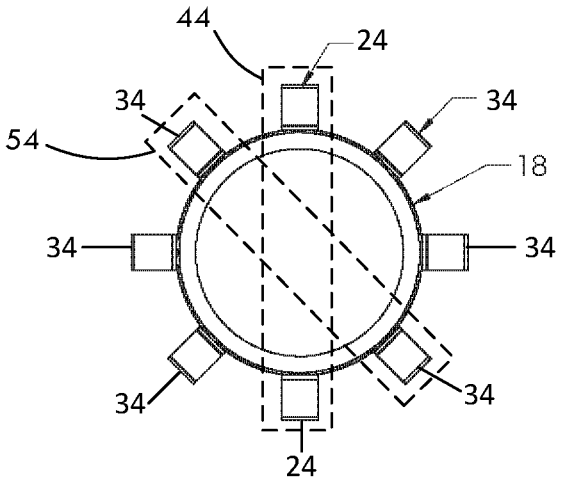
FIG. 5B illustrates an end view of one embodiment of a centralizer having fewer than all of the bow springs being asymmetrical.
Figure 5A:
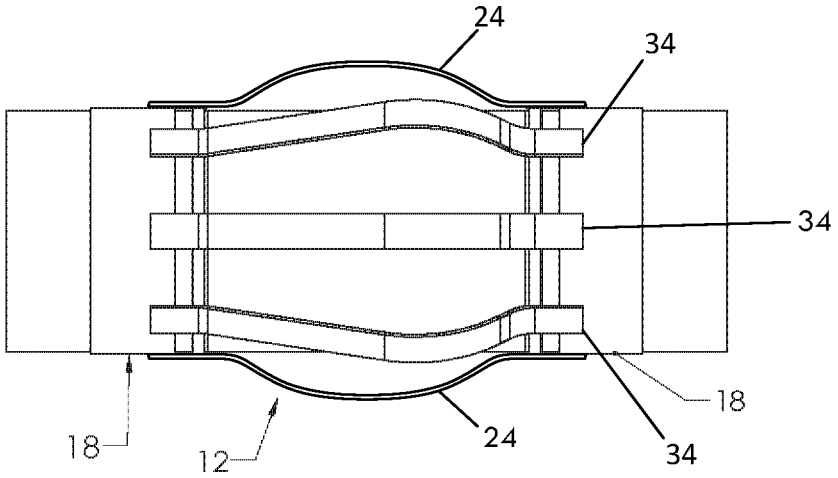
FIG. 5A illustrates a side view of one embodiment of a centralizer having fewer than all of the bow springs being asymmetrical.

With reference to FIGS. 5A and 5B, different views of a centralizer device 12 having symmetrical bow springs 24 and asymmetrical bow springs 34 are illustrated. In the illustrated example, fewer than all of the bow springs are asymmetrical. In the illustrated example, apexes of some of the bow springs are longitudinally offset from apexes of others of the bow springs. In the illustrated example, an opposed pair of bow springs 44 comprising two of symmetrical bow springs 24 has a different degree of apex offset from an adjacent pair of opposed bow springs 54 comprising two of asymmetrical bow springs 34.

While various embodiments are described in the context of wellbore applications, the centralizer and bow spring profiles described herein may provide similar advantages in other applications. Finally, while the present invention has been described above with reference to various exemplary embodiments, many changes, combinations and modifications may be made to the exemplary embodiments without departing from the scope of the present invention. For example, the various components may be implemented in alternative ways. These alternatives can be suitably selected depending upon the particular application or in consideration of any number of factors associated with the operation of the device. In addition, the techniques described herein may be extended or modified for use with other types of devices. These and other changes or modifications are intended to be included within the scope of the present invention.

What is claimed is:

1. A centralizer comprising:

a pair of opposed stop collars; and a plurality of bow springs extending between and permanently attached to the opposed stop collars;

wherein each of at least two of the plurality of bow springs defines an asymmetrical profile characterized by a more-gradual lead-in angle and a steeper retreat angle;

wherein said each of at least two of the plurality of bow springs are arranged such that the apex of each is equidistant from one of the pair of opposed stop collars;

wherein fewer than all of the plurality of bow springs are asymmetrical.

2. The centralizer of claim 1, wherein the slope of the asymmetrical profile of at least one of the said at least two bow springs has an apex distant from the centerline of an arch of the profile.

3. The centralizer of claim 2, wherein each of the said at least two bow springs has a lead-in angle substantially less than about 45 degrees and the slope of the retreat is substantially greater than about 45 degrees.

4. The centralizer of claim 3, wherein the lead-in angle is about three-fourths of the retreat angle.

5. The centralizer of claim 3, wherein the lead-in angle is about two-thirds of the retreat angle.

6. The centralizer of claim 3, wherein the lead-in angle is about one-half of the retreat angle.

7. A centralizer comprising a plurality of bow springs retained between and permanently attached to a pair of stop collars, each of said plurality of bow springs having a leading side and a trailing side wherein each of at least two of the plurality of bow springs defines a more-shallow lead-in angle on the leading side of the bow spring than the trailing side of the bow spring, wherein said each of at least two of the plurality of bow springs are arranged such that the apex of each is equidistant from one of the pair of opposed stop collars, and further wherein fewer than all of the plurality of bow springs are asymmetrical.

8. The centralizer of claim 7, wherein the plurality of bow springs is uniformly asymmetrical.

9. The centralizer of claim 7, wherein apexes of some of the plurality of bow springs are longitudinally offset from apexes of others of the plurality of bow springs.

10. The centralizer of claim 7, wherein the lead-in angle is between about 5-30 degrees.

11. The centralizer of claim 7, wherein the more-shallow lead-in angle is characterized by a substantially linear bow-spring profile between one of the stop collars and an apex of the respective bow spring.

12. A method of making a centralizer comprising: providing a pair of opposed stop collars; and permanently attaching the stop collars to a plurality of bow springs extending therebetween;

wherein each of at least two of the plurality of bow springs defines an asymmetrical profile characterized by a more-gradual lead-in profile and a steeper retreat profile, wherein fewer than all of the plurality of bow springs are asymmetrical, and further wherein said each of at least two of the plurality of bow springs are arranged such that the apex of each is equidistant from one of the pair of opposed stop collars.

13. The method of claim 12, further comprising positioning an apex of each of the at least two of the plurality of bow springs offset by between 20-30 percent from a midpoint of the distance between the stop collars.

14. The method of claim 12, wherein the steeper retreat profile is characterized by a transition from a convex profile to a concave profile.

15. The method of claim 12, wherein the more-gradual lead-in profile is characterized by a substantially linear angled profile between one of the stop collars and an apex of the respective bow spring.

16. The method of claim 12, wherein an opposed pair of bow springs has a different degree of a first apex offset from a second apex of an adjacent pair of opposed bow springs.

17. The method of claim 12, further comprising fixing at least one end of each of the plurality of bow springs within a recess defined in the stop collar.

* * * * *